US011187147B2

(12) United States Patent
Kojima et al.

(10) Patent No.: US 11,187,147 B2
(45) Date of Patent: Nov. 30, 2021

(54) WORK MACHINE

(71) Applicant: HONDA MOTOR CO., LTD., Tokyo (JP)

(72) Inventors: Hiroaki Kojima, Wako (JP); Masashi Kai, Wako (JP); Jun Yamamoto, Wako (JP); Mitsuhiro Ito, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 17/271,302

(22) PCT Filed: Sep. 6, 2018

(86) PCT No.: PCT/JP2018/033096

§ 371 (c)(1),
(2) Date: Feb. 25, 2021

(87) PCT Pub. No.: WO2020/049697

PCT Pub. Date: Mar. 12, 2020

(65) Prior Publication Data

US 2021/0340903 A1 Nov. 4, 2021

(51) Int. Cl.

| | |
|---|---|
| ***F02M 1/00*** | (2006.01) |
| ***F02B 63/04*** | (2006.01) |
| ***F02M 37/00*** | (2006.01) |

(52) U.S. Cl.

CPC ..... *F02B 63/048* (2013.01); *F02M 37/0082* (2013.01); *F02B 2063/045* (2013.01)

(58) Field of Classification Search

CPC ..... F02D 2250/02; F02M 25/08; F02M 25/0836; F02M 25/0872; F02M 55/007;

(Continued)

(56) References Cited

U.S. PATENT DOCUMENTS 4,646,701 A * 3/1987 Fukumoto ..... F02M 25/08 123/516
5,596,971 A * 1/1997 Kidokoro ..... B60K 15/03504 123/516

(Continued)

FOREIGN PATENT DOCUMENTS

JP S51-119413 9/1976
JP S60-119647 8/1985

(Continued)

OTHER PUBLICATIONS

International Search Report, dated Nov. 20, 2018, 2 pages.

(Continued)

*Primary Examiner* — John Kwon
(74) *Attorney, Agent, or Firm* — Rankin, Hill & Clark LLP

(57) ABSTRACT

A pressure variation in a fuel tank can be prevented, and leakage of liquid fuel can be prevented even if the fuel tank is inclined in a predetermined direction, without operation for opening and closing a breather passage. An engine generator includes: a first breather passage having an opening at a position above a liquid fuel in a tank bulge section when the engine generator is inclined to the right (corresponding to a first direction); and a second breather passage having an opening at a position above the liquid fuel in the tank bulge section when the engine generator is inclined in the left direction (a second direction).

8 Claims, 10 Drawing Sheets

(58) Field of Classification Search
CPC . B60K 15/03; Y10T 137/86212; B65D 51/16; B65D 2205/00
USPC ..... 123/516; 220/563
See application file for complete search history.

(56) References Cited

U.S. PATENT DOCUMENTS

| | | | | |
|---|---|---|---|---|
| 5,901,687 | A * | 5/1999 | Tasaki | F02B 63/02 123/516 |
| 7,353,808 | B2 * | 4/2008 | Kakoo | F16K 24/042 123/516 |
| 2003/0230288 | A1 * | 12/2003 | King | F02M 37/20 123/516 |
| 2007/0017918 | A1 | 1/2007 | Kirk et al. | |

FOREIGN PATENT DOCUMENTS

| | | |
|---|---|---|
| JP | S61-032036 | 2/1986 |
| JP | 3491858 B2 | 1/2004 |
| JP | 2014-025456 | 2/2014 |

OTHER PUBLICATIONS

International Preliminary Report on Patentability (PCT/IPEA/409), 8 pages.
Written Opinion of the International Searching Authority dated Nov. 20, 2018 filed in PCT/JP2018/033096, 5 pages.
International Preliminary Report on Patentability dated Mar. 11, 2021, 6 pages.
Indian Office Action dated Jul. 15, 2021, 6 pages.

* cited by examiner

WORK MACHINE

TECHNICAL FIELD

The present invention relates to a work machine including a fuel tank.

BACKGROUND ART

Work machines include a portable generator (also referred to as an engine generator) that uses liquid fuel stored in a fuel tank to generate electricity (see, for example, Patent Literature 1).

There is known a portable generator of this type in which a breather passage is provided in a tank cap that is detachably provided in the fuel tank, and the breather passage is manually openable and closable.

The breather passage is closed during transportation or storage of the portable generator, so that fuel leakage from the breather passage can be avoided even if the portable generator topples over during transportation. On the other hand, when the portable generator is used, the breather passage can be opened to avoid a situation in which the fuel tank has a negative pressure inside due to a decrease in fuel to have difficulty in supplying fuel.

CITATION LIST

Patent Literature

Patent Literature 1: Japanese Patent Laid-Open No. 2014-25456

SUMMARY OF INVENTION

Technical Problem

However, in the conventional configuration, when the breather passage is closed during transportation or storage, the fuel tank is sealed. Therefore, the pressure inside the fuel tank rises due to the vapor pressure of gasoline as the outside air temperature rises. On the contrary, when the temperature is low, the fuel tank has a negative pressure inside. In accordance with this pressure variation, it is necessary to improve the strength of the fuel tank and the pressure resistance of the fuel system components.

In addition, in the conventional configuration, operation is necessary to close the breather passage at a time of transportation or storage and to open the breather passage at a start of use, which becomes a factor that reduces user-friendliness. If a user forgets to close the breather passage, the fuel may leak when the portable generator topples over or the like. Also, if a user forgets to open the breather passage at a start of use, it may lead to sudden stoppage of the electric power generation.

Therefore, an object of the present invention is, without operation for opening and closing a breather passage, to enable preventing pressure variation in a fuel tank and to enable preventing leakage of liquid fuel even if the fuel tank is inclined in a predetermined direction.

Solution to Problem

In order to achieve the object, provided is a work machine, including a fuel tank for storing liquid fuel, wherein the fuel tank has a tank shape having a fuel supply port, the tank shape bulging to a position higher than the fuel supply port, wherein the fuel tank comprises a breather passage through which an inside and outside of a tank bulge section communicate with each other, the tank bulge section being a portion higher than the fuel supply port, and wherein the breather passage includes: a first breather passage having an opening at a position above the liquid fuel in the tank bulge section when the work machine is inclined in a predetermined first direction, the first breather passage being routed so as to include a position above the liquid fuel when the work machine is inclined in a second direction different from the first direction; and a second breather passage having an opening at a position above the liquid fuel in the tank bulge section when the work machine is inclined in the second direction, the second breather passage being routed so as to include a position above the liquid fuel when the work machine is inclined in the first direction.

In the above configuration, the first breather passage extends from the opening of the first breather passage along the first direction and then extends downward along a side wall of the fuel tank, and the second breather passage extends from the opening of the second breather passage along the second direction, then turns back to extend along the first direction, and then extends downward along the side wall of the fuel tank.

In the above configuration, the first and second breather passages have a downward slope toward the opening of the first breather passage and the opening of the second breather passage, respectively.

In addition, in the above configuration, the first direction is one of left and right directions, and the second direction is the other of the left and right directions, and each of the opening of the first breather passage and the opening of the second breather passage is provided at an intermediate position in a front-rear direction of the fuel tank.

In addition, in the above configuration, the first and second breather passages are arranged in the fuel tank, exit from a predetermined position in the fuel tank, and subsequently are connected to a canister or an air cleaner case.

In addition, in the above configuration, a portion of the first breather passage except for the opening of the first breather passage and a portion of the second breather passage except for the opening of the second breather passage are arranged outside the fuel tank, and the first and second breather passages are connected to a canister or an air cleaner case.

In addition, in the above configuration, the fuel tank has a wave protection member arranged around the opening of the first breather passage and the opening of the second breather passage in the fuel tank to enable preventing a wave of the liquid fuel from getting into the opening of the first breather passage and the opening of the second breather passage.

In addition, in the above configuration, the work machine is a portable type generator that uses the liquid fuel in the fuel tank to generate electricity.

Advantageous Effects of Invention

The fuel tank included in the work machine includes a breather passage through which an inside and outside of a tank bulge section communicate with each other, the tank bulge section being a portion higher than the fuel supply port, the breather passage includes: a first breather passage having an opening at a position in the tank bulge section above the liquid fuel in the fuel tank when the work machine is inclined in a predetermined first direction, the first breather passage being routed so as to include a position above the liquid fuel when the work machine is inclined in a second direction different from the first direction; and a second breather passage having an opening at a position above the liquid fuel in the tank bulge section when the work machine is inclined in the second direction, the second breather passage being routed so as to include a position above the liquid fuel when the work machine is inclined in the first direction. This configuration can prevent the pressure variation in the fuel tank, and can prevent the leakage of the liquid fuel even if the fuel tank is inclined in a predetermined direction, without operation for opening and closing the breather passages.

DESCRIPTION OF EMBODIMENTS

Embodiments of the present invention are described below with reference to the drawings.

First Embodiment

Figure 1:
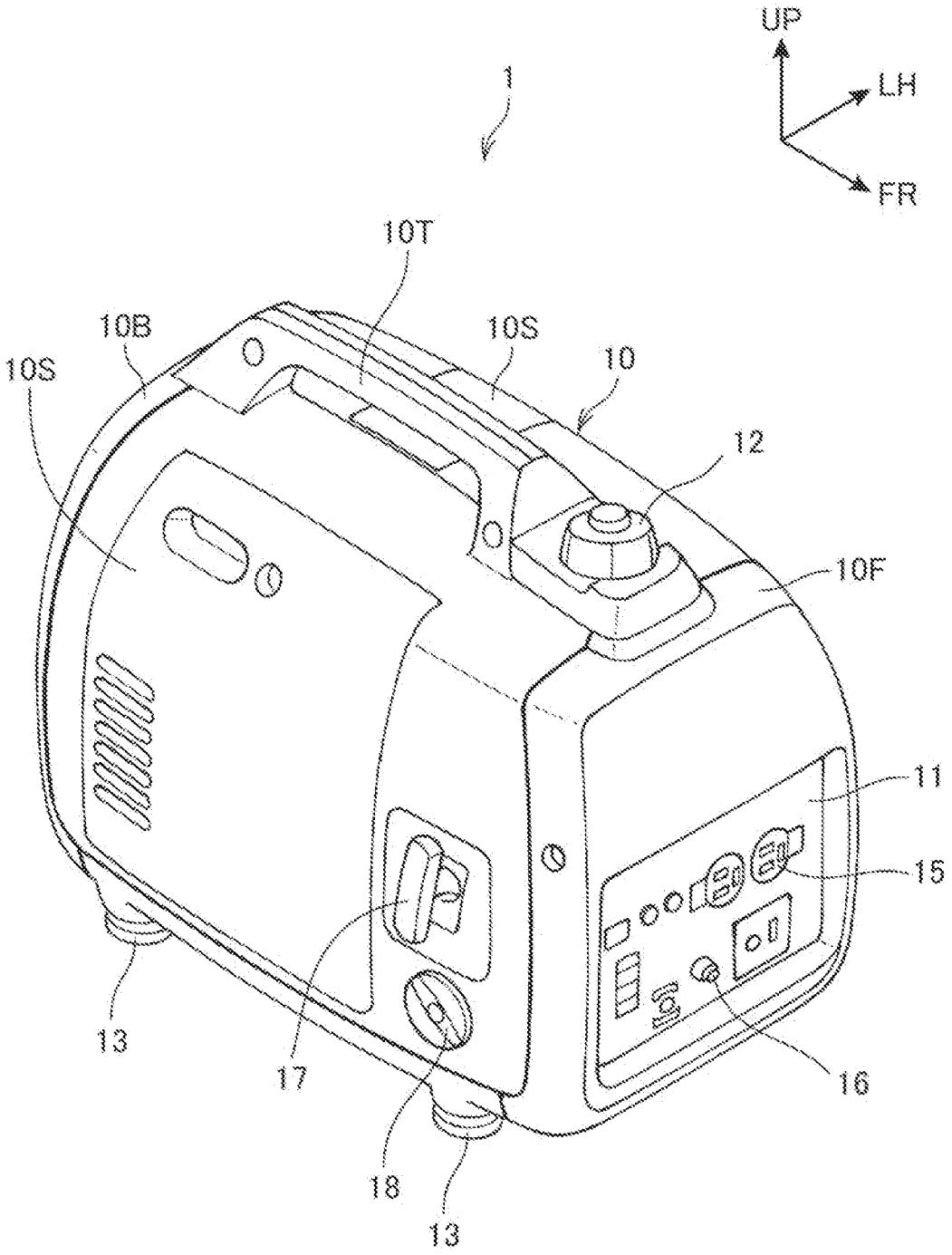
FIG. 1 is a perspective view showing an appearance of an engine generator according to a first embodiment of the present invention.

FIG. 1 is a perspective view showing an appearance of an engine generator according to a first embodiment of the present invention. An engine generator 1 is a small, light portable type generator that can be carried relatively easily, and is formed in a substantially rectangular parallelepiped shape as a whole.

As shown in FIG. 1, the engine generator 1 includes a substantially rectangular parallelepiped housing 10, and a control panel 11 is mounted on the front surface of the housing 10. In FIG. 1 and each figure to be described below, a reference character FR denotes the front side of the engine generator 1, a reference character UP denotes the upper side of the engine generator 1, and a reference character LH denotes the left-hand side of the engine generator 1.

The housing 10 includes: a front cover 10F that covers the front surface of the engine generator 1 with the control panel 11 exposed; side covers 10S that cover the left and right sides of the engine generator 1; a rear cover 10B that covers the rear surface of the engine generator 1; and an undercover 10L that covers the lower surface of the engine generator 1. A handle 10T to be gripped by a user is provided on the upper part of the housing 10, and a tank cap 12 is detachably provided on the front surface side of the handle 10T. A plurality of legs 13 are provided at the lower part of the housing 10.

The control panel 11 is provided with terminals such as a power outlet 15, operation switches such as a frequency switching switch 16, and so on. In addition, a recoil starter 17 and a fuel cock operation knob 18 are provided on the right side surface of the engine generator 1.

Figure 2:
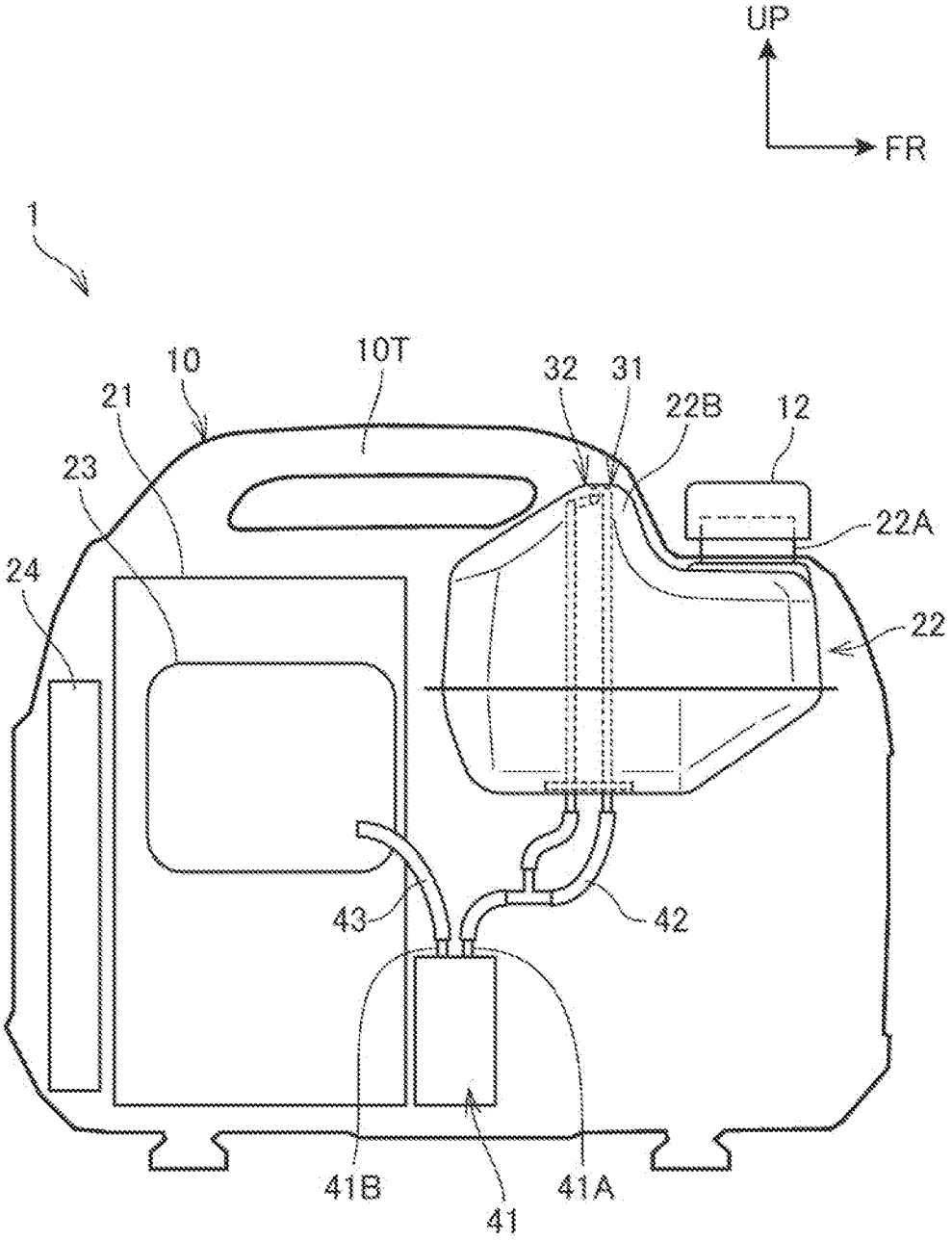
FIG. 2 is a diagram schematically showing an internal configuration of the engine generator.

FIG. 2 is a diagram schematically showing an internal configuration of the engine generator 1.

As shown in FIG. 2, an engine 21 is arranged in the housing 10, and a fuel tank 22 is arranged above the front of the engine 21. An engine intake system such as an air cleaner case 23 is arranged on the side of the engine 21 (corresponding to the front upper part in the housing 10). In addition, an engine exhaust system such as a muffler 24 is arranged behind the engine 21 (corresponding to the rear part in the housing 10).

The engine 21 to be employed is an internal combustion engine whose energy source is a predetermined liquid fuel such as gasoline. The engine generator 1 is configured to generate electricity with an alternator using the driving force of the engine 21, to convert the generated electric power into predetermined electric power by an inverter, and to supply the generated electric power to the power outlet 15 or the like.

The fuel tank 22 stores the liquid fuel to be supplied to the engine 21. The fuel tank 22 is provided with two breather passages 31 and 32, and these breather passages 31 and 32 function as communication members for causing the inside of the fuel tank 22 to communicate with the space outside the fuel tank 22. The communication of the fuel tank 22 with the outside space enables the pressure inside the fuel tank 22 to be prevented from fluctuating due to change in the outside air temperature, consumption of liquid fuel, or the like. This can appropriately supply fuel, and the demands for the strength of the fuel tank 22 and the pressure resistance of the fuel system components are easily moderated.

In the configuration shown in FIG. 2, a canister 41 is arranged in the engine generator 1 and the two breather passages 31 and 32 to be connected to the canister 41, so that the adsorbent in the canister 41 adsorbs evaporated fuel that generated by evaporating the fuel in the fuel tank 22. The canister 41 includes: a first connection port 41A to which the two breather passages 31 and 32 are connected via a piping member 42 made of a rubber tube and the like; and a second connection port 41B that is connected to the air cleaner case 23 via a piping member 43 such as a rubber tube. This configuration can supply the fuel adsorbed in the canister 41 to the air cleaner case 23.

That is, the evaporated fuel generated in the fuel tank 22 is collected in the canister 41 via the breather passages 31 and 32, and the collected fuel is supplied to the air cleaner case 23, so that the fuel can be supplied to the engine 21 to be used for electric power generation.

The canister 41 is at a position corresponding to the middle of the fuel tank 22 and the air cleaner case 23, and is arranged in a region below the fuel tank 22 and the air cleaner case 23. Note that the positions of the canister 41, the fuel tank 22, and the air cleaner case 23 may be changed as appropriate. In addition, a known canister can be widely applied to the canister 41. There is obtained an advantage that, when gas emissions including evaporated fuel are regulated, the gas emissions with the canister 41 provided can easily meet the regulatory values.

However, the configuration of the engine generator is not limited to a configuration in which the canister 41 is arranged in the engine generator 1. For example, in an area where the regulation value of the gas emissions including evaporated fuel is not so strict or the like, the two breather passages 31 and 32 may be configured to be connected directly to the air cleaner case 23, or the two breather passages 31 and 32 may be configured to be opened to the space outside the fuel tank 22.

The fuel tank 22 and the breather passages 31 and 32 are further described below.

Figure 3:
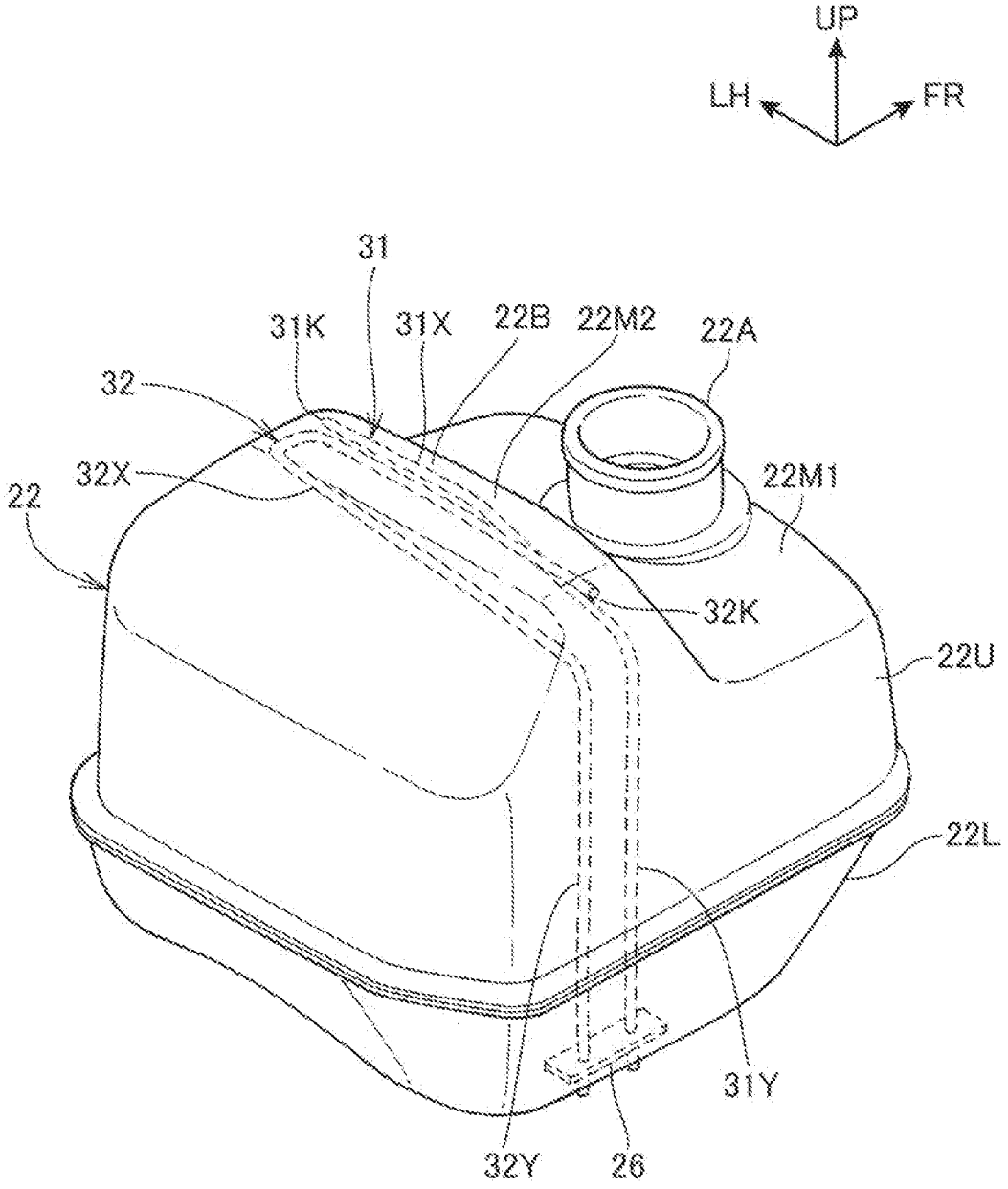
FIG. 3 is a perspective view showing a fuel tank together with breather passages.
Figure 4:
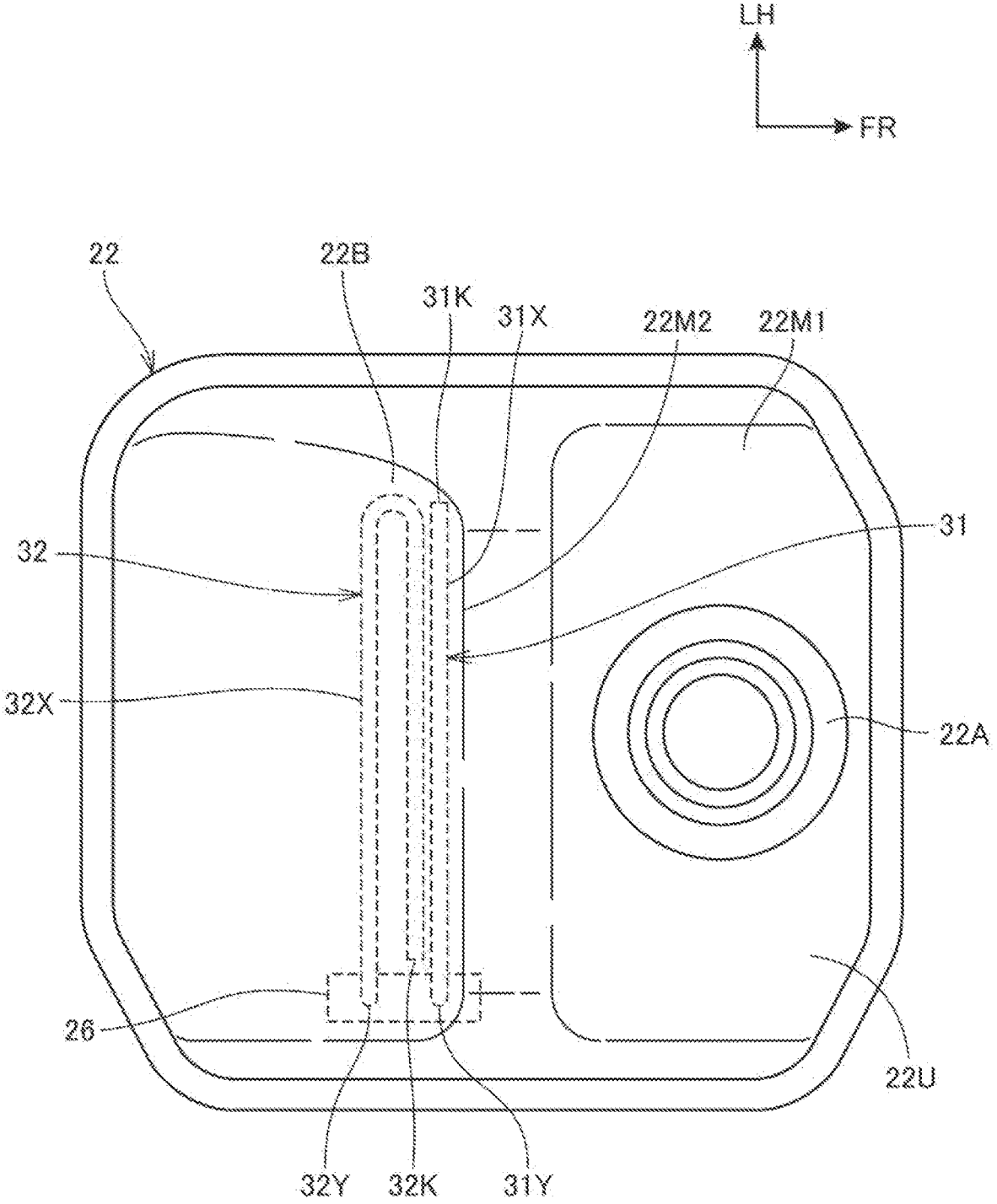
FIG. 4 is the top view showing the fuel tank together with the breather passages.
Figure 5:
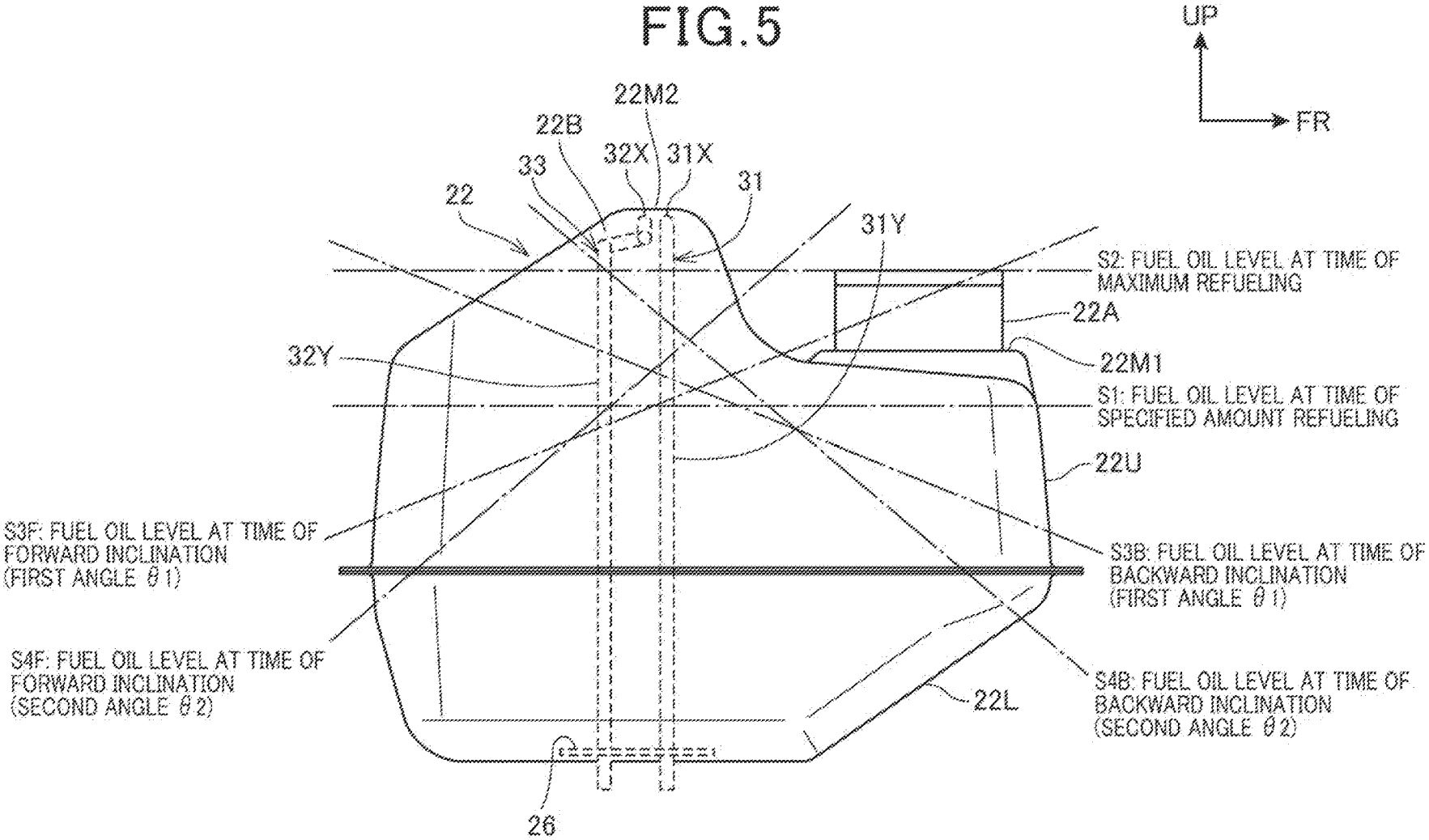
FIG. 5 is a side sectional view showing the fuel tank together with the breather passages.

FIG. 3 is a perspective view showing the fuel tank 22 together with the breather passages 31 and 32, FIG. 4 is the top view, and FIG. 5 is a side sectional view. The breather passages 31 and 32 are arranged in the fuel tank 22, penetrate the bottom plate of the fuel tank 22, and subsequently are connected to the canister 41.

As shown in FIGS. 3 to 5, the fuel tank 22 is formed in a tank shape integrally having a fuel supply port 22A that opens upward, and a tank bulge section 22B that bulges to a position higher than the fuel supply port 22A. The fuel tank 22 is formed by joining: a lower tank portion 22L configuring the lower part of the fuel tank; and an upper tank portion 22U configuring the upper part of the fuel tank, together by welding or the like. The fuel tank 22 is thus formed in a structure that is divided into upper and lower portions, so that the upper surface and the lower surface are easily made into a complicated shape having unevenness and inclinations, and the breather passages 31 and 32 are easily arranged in the fuel tank 22.

The upper surface of the fuel tank 22 has a fuel supply port arrangement surface 22M1 on which the fuel supply port 22A is arranged, and an upward bulging surface 22M2 that has a shape that bulges above the fuel supply port arrangement surface 22M1.

As shown in FIGS. 3 and 4, the fuel supply port arrangement surface 22M1 extends over the width direction at the front portion of the upper surface of the fuel tank 22, and is provided with the fuel supply port 22A in the center in the width direction so as to face upward.

In addition, the upward bulging surface 22M2 ranges behind the fuel supply port arrangement surface 22M1 and extends over the width direction of the fuel tank 22. As shown in FIG. 5, the upward bulging surface 22M2 is formed in a substantially V-shaped cross section in which the front-rear length decreases to the upper side, and projects upward to a position higher than the fuel supply port 22A. As a result, the tank bulge section 22B is formed in the fuel tank 22 at a position higher than the fuel supply port 22A.

Note that the fuel supply port 22A is closed by attaching the tank cap 12. The tank cap 12 is formed in a cap having a sealed structure, in other words, a cap having no air passage such as a breather passage penetrating the tank cap 12. As a result, the tank cap 12 attached to the fuel supply port 22A does not leak the fuel to the outside through the tank cap 12 even if the engine generator 1 inclines in various directions or topples over or the like.

When the fuel tank 22 is arranged in the housing 10, as shown in FIG. 2, the tank bulge section 22B is housed in an empty space in the housing 10 on the front side of the handle 10T. As a result, the engine generator 1 is easily made to have an appearance shape similar to that of a conventional engine generator provided with a fuel tank having no tank bulge section 22B, and the engine generator 1 is easily prevented from increasing in size thereof.

In FIG. 5, a reference character S1 denotes a fuel oil level when the fuel tank 22 is refueled with a specified amount of fuel, and the engine generator 1 is installed on a horizontal surface. In addition, a reference character S2 denotes a fuel oil level when the fuel is supplied to the upper surface of the fuel supply port 22A and the engine generator 1 is installed on a horizontal surface (corresponding to the fuel oil level at a time of maximum refueling).

In addition, reference character S3F denotes a fuel oil level when the fuel tank 22 is refueled with a specified amount of fuel, and the engine generator 1 is inclined forward by a first angle θ1 (22° in this embodiment) to lower the front. In addition, a reference character S3B denotes the fuel oil level when the fuel tank 22 is refueled with a specified amount of fuel, and the engine generator 1 is inclined backward by the first angle θ1 to lower the rear.

In addition, a reference character S4F denotes the fuel oil level when the fuel tank 22 is refueled with a specified amount of fuel, and the engine generator 1 is inclined forward by a second angle θ2 (50° in the present embodiment) larger than the first angle θ1 to lower the front. In addition, a reference character S4B denotes the fuel oil level when the fuel tank 22 is refueled with a specified amount of fuel, the engine generator 1 is inclined backward by the second angle θ2 to lower the rear.

As shown in FIG. 5, the tank bulge section 22B having this configuration is provided at an intermediate position in the front-rear direction of the fuel tank 22, and is located at a position higher than any of the fuel oil levels S1, S2, S3F, S3B, S4F and S4B. Respective openings 31K and 32K of the breather passages 31 and 32 are located in the tank bulge section 22B. Therefore, when the engine generator 1 is arranged on a horizontal surface, and when it is inclined forward and backward to either the first angle θ1 or the second angle θ2 with a specified amount of fuel refueled, the respective openings 31K and 32K of the breather passages 31 and 32 are not immersed in the fuel. This enables both the breather passages 31 and 32 to prevent pressure variation in the fuel tank 22.

In addition, the seal of the fuel supply port 22A by the tank cap 12 prevents fuel from leaking from the fuel supply port 22A side even if the fuel tank 22 is inclined as described above.

In the following description, when the breather passages 31 and 32 are described with particular distinction, they are referred to as a first breather passage 31 and a second breather passage 32, respectively.

The breather passages 31 and 32 are each formed of a rigid pipe member such as a metal pipe. As shown in FIGS. 3 and 4, the first breather passage 31 integrally includes: a head portion 31X that is linear, and extends from one side (left side) in the left-right direction in the tank bulge section 22B along the right direction (corresponding to the first direction); and a base portion 31Y that is linear, bends from the other side in the left-right direction of the head portion 31X, and extends downward along a side wall of the fuel tank 22. As a result, the opening 31K of the first breather passage 31 is arranged on one side (left side) in the left-right direction in the tank bulge section 22B.

As shown in FIGS. 3 and 4, the second breather passage 32 integrally includes: a head portion 32X that has a U-shape, extends from the other side (right side) in the left-right direction in the tank bulge section 22B along the left direction (corresponding to the second direction), and then turns back to extend along the right direction (corresponding to the first direction); and a base portion 32Y that is linear, bends from the other side of the head portion 32X in the left-right direction, and extends downward along the side wall of the fuel tank 22. As a result, the opening 32K of the second breather passage 32 is arranged on the other side (right side) in the left-right direction in the tank bulge section 22B.

The respective base portions 31Y and 32Y of the breather passages 31 and 32 penetrate a fixing member 26 made of a metal plate fixed to the fuel tank 22, and extend to the outside of the fuel tank 22.

In this way, the openings 31K and 32K of the breather passages 31 and 32 are separately arranged on both the left and right sides in the tank bulge section 22B. So, when the fuel tank 22 is inclined to the right so as to lower the right side, the first breather passage 31 having an opening 31K that opens on the left side easily maintain a state in which the inside and outside of the fuel tank 22 communicate with each other. In addition, when the fuel tank 22 is inclined to the left side so as to lower the left, the second breather passage 32 having an opening 32K that opens on the right side easily maintain a state in which the inside and outside of the fuel tank 22 communicate with each other.

Figure 6:
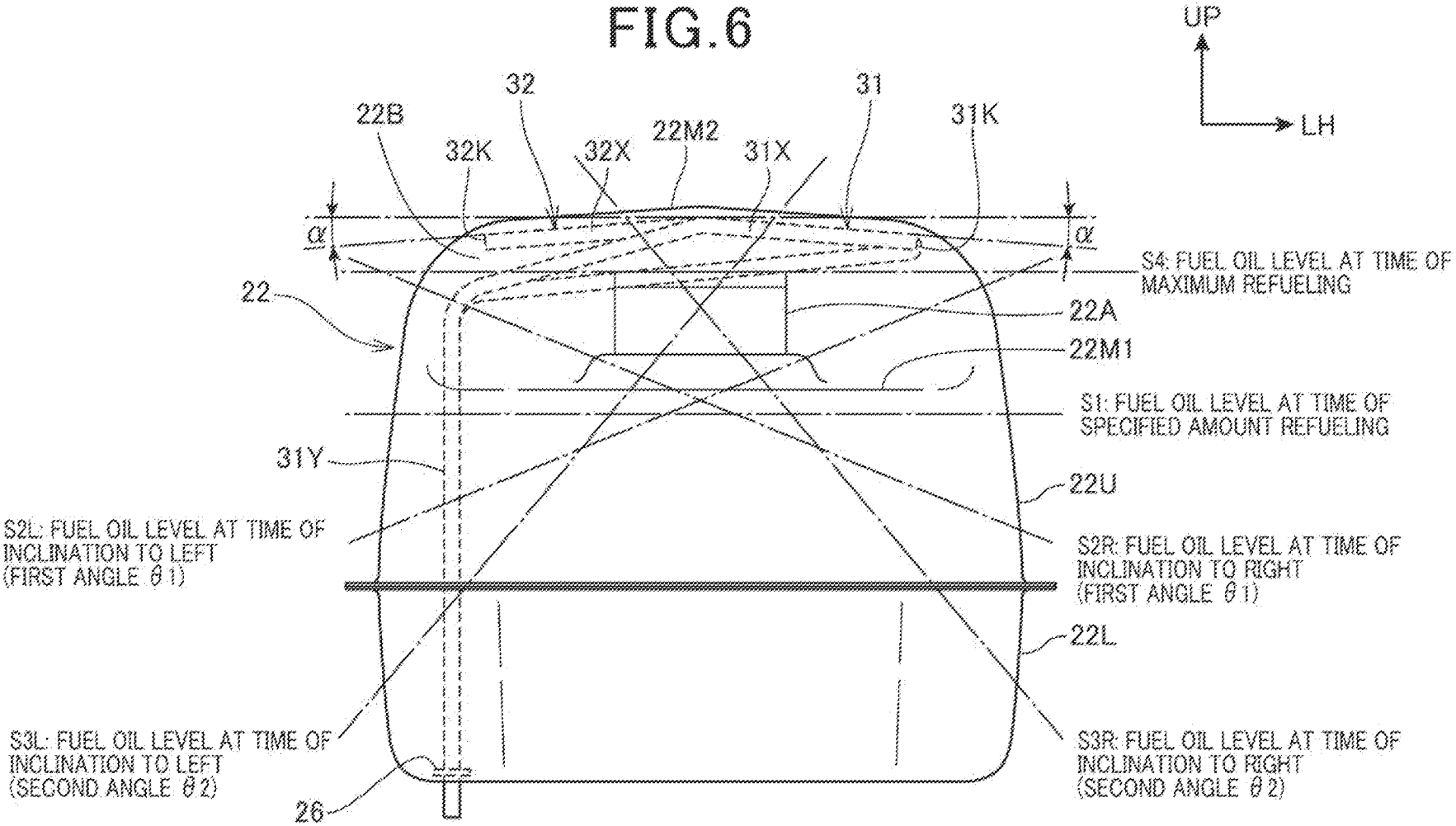
FIG. 6 is the rear view of the fuel tank together with the breather passages.

FIG. 6 is a rear view of the fuel tank 22 together with the breather passages 31 and 32. FIG. 6 shows fuel oil levels S2R, S3R, S2L, and S3L when the fuel tank 22 is inclined in the left-right direction, as well as the fuel oil levels S1 and S4. The fuel oil level S2R denotes the fuel oil level when the fuel tank 22 is refueled with a specified amount of fuel, and the engine generator 1 is inclined to the right by the first angle θ1 so as to lower the right. In addition, the fuel oil level S3R denotes the fuel oil level when the fuel tank 22 is refueled with a specified amount of fuel, and the engine generator 1 is inclined to the right by the second angle θ2 so as to lower the right.

The fuel oil level S2L denotes the fuel oil level when the fuel tank 22 is refueled with a specified amount of fuel, and the engine generator 1 is inclined to the left by the first angle θ1 so as to lower the left. In addition, the fuel oil level S3L denotes the fuel oil level when the fuel tank 22 is refueled with a specified amount of fuel, the engine generator 1 is inclined to the left by the second angle θ2 so as to lower the left.

As shown in FIG. 6, the openings 31K and 32K of the respective breather passages 31 and 32 are located above the fuel oil levels S2R and S2L. As a result, even if the engine generator 1 is inclined to the left or right to the first angle θ1, both the breather passages 31 and 32 can maintain a state in which the inside and outside of the fuel tank 22 communicate with each other, and the fuel does not leak through any of the breather passages 31 and 32.

On the other hand, when the engine generator 1 is inclined to the left or right to the second angle θ2, one of the openings 31K and 32K is located higher than the fuel oil level, while the other is located lower than the fuel oil level, so that the fuel flows into the other opening 31K or 32K.

In this case, the breather passage 31 or 32 having one opening 31K or 32K at a position higher than the fuel oil level can maintain a state in which the inside and outside of the fuel tank 22 communicate with each other to prevent the pressure variation in the fuel tank 22. However, the fuel that has flowed into the other opening 31K or 32K may leak to the outside.

As shown in FIG. 1, the engine generator 1 of this configuration, which has a shorter left-right length than the front-rear length, relatively easily topples over in the left-right direction. As a result, even in the case where the engine generator 1 is in a toppled over state inclined 90° to the left or right, the fuel flows into either the opening 31K or 32K. A case in which the fuel tank 22 is inclined 90° to the left and right is described below with reference to FIG. 7.

Figure 7:
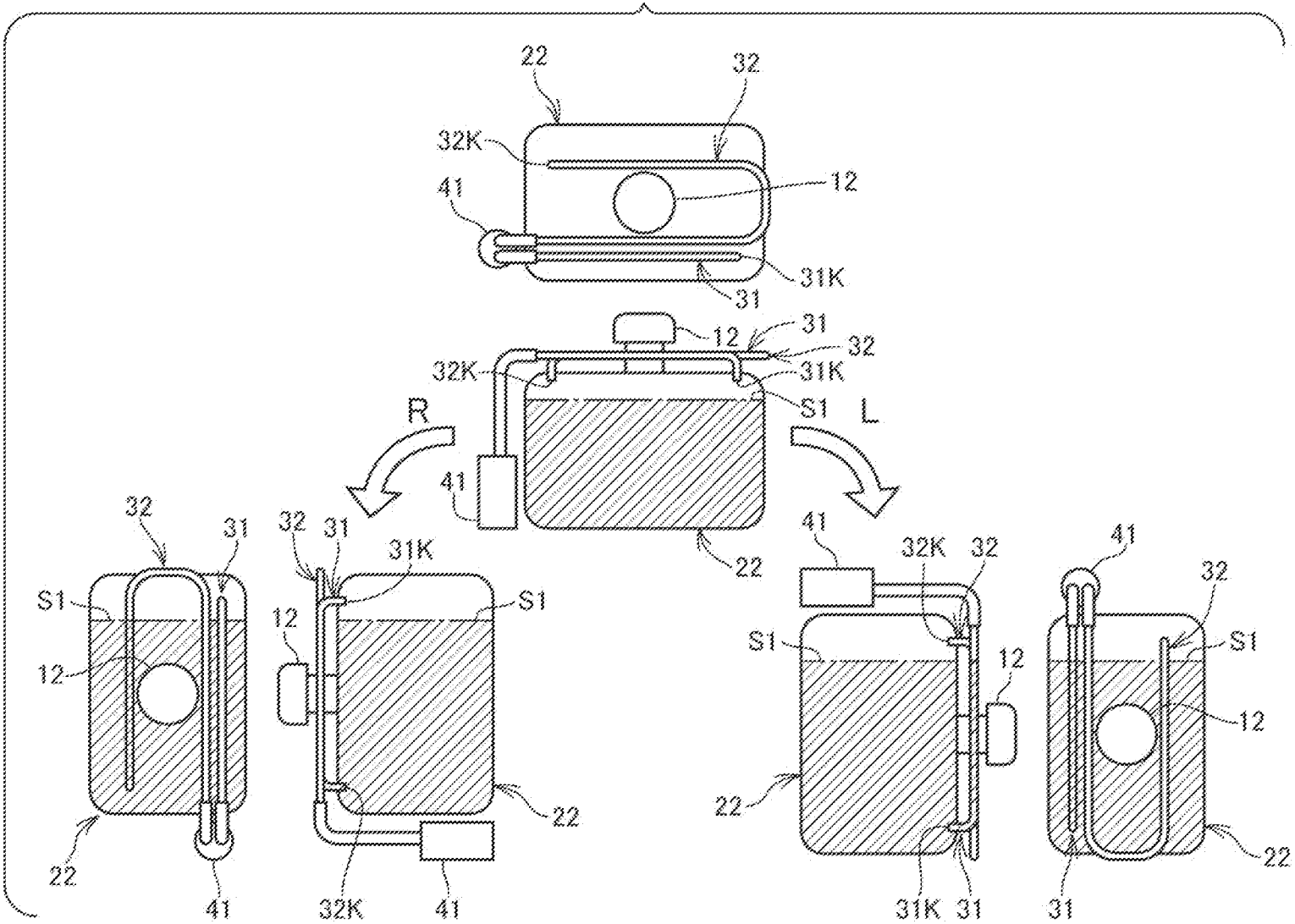
FIG. 7 is a diagram schematically showing a state before the fuel tank is inclined and states in which the fuel tank is inclined 90° to the left and right.

FIG. 7 is a diagram schematically showing a state before the fuel tank 22 is inclined and states in which the fuel tank 22 is inclined 90° to the left and right. When the fuel tank 22 topples over to the right (reference character R side in FIG. 7), the opening 31K of the first breather passage 31 is located above the liquid fuel in the tank bulge section 22B. and therefore, the first breather passage 31 prevents the pressure variation in the fuel tank 22.

In this case, the liquid fuel flows into the opening 32K of the second breather passage 32. As shown in FIG. 7, the second breather passage 32 is routed so as to include a position above the liquid fuel even if the fuel tank 22 topples over to the right (R side). As a result, no liquid fuel flows above the position, so that no liquid fuel flows from the second breather passage 32 to the canister 41 side. Therefore, even if the engine generator 1 is greatly inclined to the right, no liquid fuel leaks from any of the breather passages 31 and 32.

As shown in FIG. 7, when the fuel tank 22 topples over to the left (reference character L side in FIG. 7), the opening 32K of the second breather passage 32 is located above the liquid fuel in the tank bulge section 22B, and therefore, the second breather passage 32 prevents the pressure variation in the fuel tank 22.

In this case, the liquid fuel flows into the opening 31K of the first breather passage 31. As shown in FIG. 7, the first breather passage 31 is routed so as to include a position above the liquid fuel even if the fuel tank 22 topples over to the left (L side). As a result, no liquid fuel flows from the first breather passage 31 to the canister 41 side, so that no liquid fuel leaks from any of the breather passages 31 and 32.

In addition, in this configuration, as shown in FIG. 6, each of the breather passages 31 and 32 is formed to have a downward slope in which the head portions 31X and 32X including the respective openings 31K and 32K are inclined downward toward the respective openings 31K and 32K.

As a result, even if the liquid fuel has waves or the like generated in the fuel tank 22 due to vibration or the like from the outside, and gets into the openings 31K and 32K of the respective breather passages 31 and 32, the liquid fuel can be easily returned to the fuel tank 22. The downward slope angle α of the respective head portions 31X and 32X may be appropriately set to an angle at which the liquid fuel that has got into the openings 31K and 32K can be easily returned to the fuel tank 22 by simulation, experiment, or the like.

As described above, the engine generator 1 has: a first breather passage 31 having an opening 31K at a position above the liquid fuel in the tank bulge section 22B when the engine generator 1 is inclined to the right (corresponding to the first direction); and a second breather passage 32 having an opening 32K at a position above the liquid fuel in the tank bulge section 22B when the engine generator 1 is inclined to the left (the second direction). This can make the inside and outside of the fuel tank 22 communicate with each other to prevent the pressure variation in the fuel tank 22 without operation for opening and closing the breather passages.

In addition, the first breather passage 31 is routed so as to include a position above the liquid fuel when the engine generator 1 is inclined to the left (the second direction), and the second breather passage 32 is routed so as to include a position above the liquid fuel when the engine generator 1 is inclined to the right (the first direction). This can prevent the liquid fuel from leaking from the breather passages 31 and 32 even if the fuel tank 22 is inclined either to the left or right.

These can prevent the pressure variation in the fuel tank 22, and can prevent the leakage of the liquid fuel even if the fuel tank 22 is inclined in the left-right direction, without operation for opening and closing the breather passages 31 and 32. Therefore, the configuration can be simplified and user-friendliness thereof is improved as compared with the conventional configuration in which the tank cap 12 is provided with the breather passage that is manually openable and closable.

In addition, the first breather passage 31 extends from the opening 31K of the breather passage 31 along the right direction, and then extends downward along the side wall of the fuel tank 22, and the second breather passage 32 extends from the opening 32K of the breather passage 32 along the left direction, turns back to extend along the right direction, and then extends downward along the side wall of the fuel tank 22. This configuration enables the respective breather passages 31 and 32 to be easily laid out compactly and to be collectively arranged on the right side of the fuel tank 22.

In addition, the breather passages 31 and 32 have a downward slope toward the respective openings 31K and 32K, which can easily return liquid fuel into the fuel tank 22 even if liquid fuel gets into the openings 31K and 32K.

In addition, the openings 31K and 32K of the respective breather passages 31 and 32 are provided at the intermediate positions in the front-rear direction of the fuel tank 22, which allows the openings 31K and 32K to be easily located above the fuel oil level even when the fuel tank 22 is inclined in either the front-rear direction. This easily prevents the pressure variation in the fuel tank 22 and prevents the leakage of liquid fuel from the breather passages 31 and 32 even if the fuel tank 22 is inclined in either the front or rear direction.

In addition, the respective breather passages 31 and 32 are arranged in the fuel tank 22, exit from the predetermined position of the fuel tank 22, and subsequently are connected to the canister 41 or the air cleaner case 23. This configuration enables the breather passages 31 and 32 to be arranged using the space in the fuel tank 22, and advantageously works for complying with regulations on gas emissions and avoiding waste of fuel.

Moreover, the breather structure including the breather passages 31 and 32 is applied to the portable type engine generator 1 whose installation surface is not limited to a horizontal surface and whose space for arranging components are also restricted, and therefore, the usability of this type of generator can be further improved.

Second Embodiment

Figure 8:
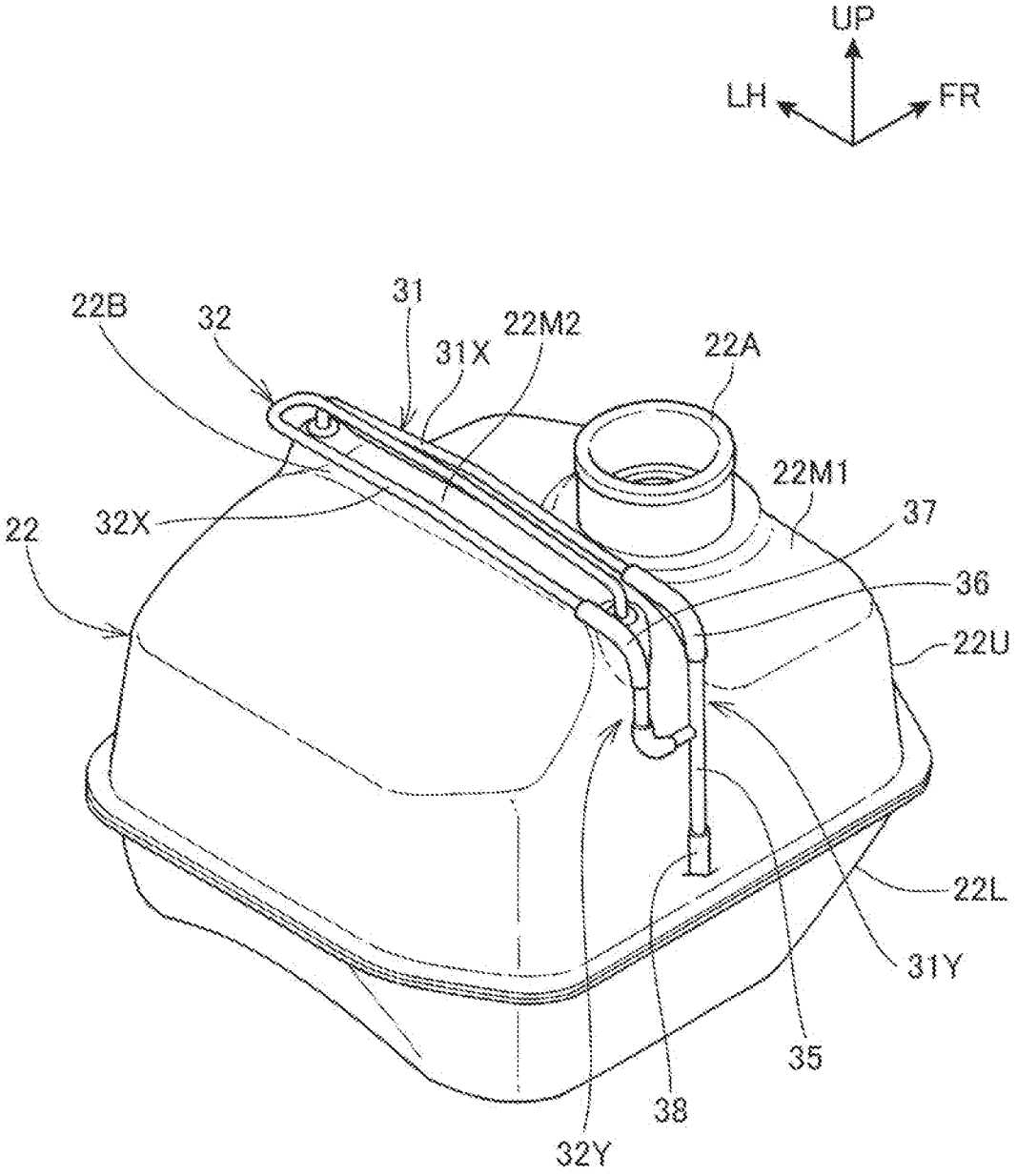
FIG. 8 is a perspective view showing a fuel tank of an engine generator according to a second embodiment together with a peripheral configuration.

FIG. 8 is a perspective view showing a fuel tank 22 of an engine generator 1 according to a second embodiment together with a peripheral configuration.

In the second embodiment, respective breather passages 31 and 32 are arranged outside the fuel tank 22 except for respective openings 31K and 32K. More specifically, a first breather passage 31 is configured with: a head portion 31X that penetrates the upper surface of a tank bulge section 22B from an opening 31K in the tank bulge section 22B and is routed above the fuel tank 22; and a base portion 31Y that is connected to the right end portion of the head portion 31X.

In addition, a second breather passage 32 is configured with: a head portion 32X that penetrates the upper surface of the tank bulge section 22B from an opening 32K in the tank bulge section 22B and is routed above the fuel tank 22; and a base portion 32Y that is connected to the left end portion of the head portion 32X.

The head portion 31X of the first breather passage 31 is formed of a linear pipe member extending above the tank bulge section 22B in the right direction. In addition, the base portion 31Y of the first breather passage 31 is formed of a pipe member that extends downward outside the fuel tank 22, from the right end portion of the head portion 31X along the side wall of the fuel tank 22.

The head portion 32X of the second breather passage 32 is formed of a U-shaped pipe member that extends above the tank bulge section 22B in the left direction, and then turns back to extend along the right direction. In addition, the base portion 32Y of the second breather passage 32 extends downward outside the fuel tank 22, from the right end portion of the head portion 32X along the side wall of the fuel tank 22.

In this configuration, the base portions 31Y and 32Y of the respective breather passages 31 and 32 are formed of separate components from the head portions 31X and 32X of the respective breather passages 31 and 32. In FIG. 8, the base portions 31Y and 32Y are configured with: a hose joint (also called a three-way hose joint) 35 having four connection ports; and piping members 36 and 37 such as rubber tubes or resin tubes that connect the two connection ports of the hose joint 35 to the head portions 31X and 32X. The connection port located at the lower end of the hose joint 35 (the connection port to which any of the base portions 31Y and 32Y are not connected) is connected to a canister 41 or an air cleaner case 23 via a piping member 38 such as a rubber tube or a resin tube.

The individual components configuring the base portions 31Y and 32Y shown in FIG. 8 may be part of an existing piping member. Note that the configuration of the fuel tank of the engine generator and the peripheral configuration are not limited to the above configuration, and the base portions 31Y and 32Y may be formed of a tubular integral component, the base portions 31Y and 32Y may be formed as an integral component with each of the head portions 31X and 32X, and the base portions 31Y and 32Y may be configured not to connect to each other. In addition, the material of the base portions 31Y and 32Y is not limited to rubber or resin, and other materials such as metal may be applied.

Without operation for opening and closing the breather passages 31 and 32, the configuration of the second embodiment also can bring various effects similar to those of the first embodiment such as: preventing the pressure variation in the fuel tank 22; and preventing the leakage of liquid fuel even if the fuel tank 22 is inclined in the left-right direction.

In addition, in the second embodiment, the breather passages 31 and 32 can be arranged by using the space outside the fuel tank 22. Therefore, there are gained advantages that the tank capacity is not restricted by the breather passages 31 and 32, and the empty space outside the fuel tank 22 can be used. In the present embodiment, the case in which the breather passages 31 and 32 are arranged above the fuel tank 22 is illustrated, but the configuration of the engine generator is not limited to this arrangement.

Third Embodiment

Figure 9:
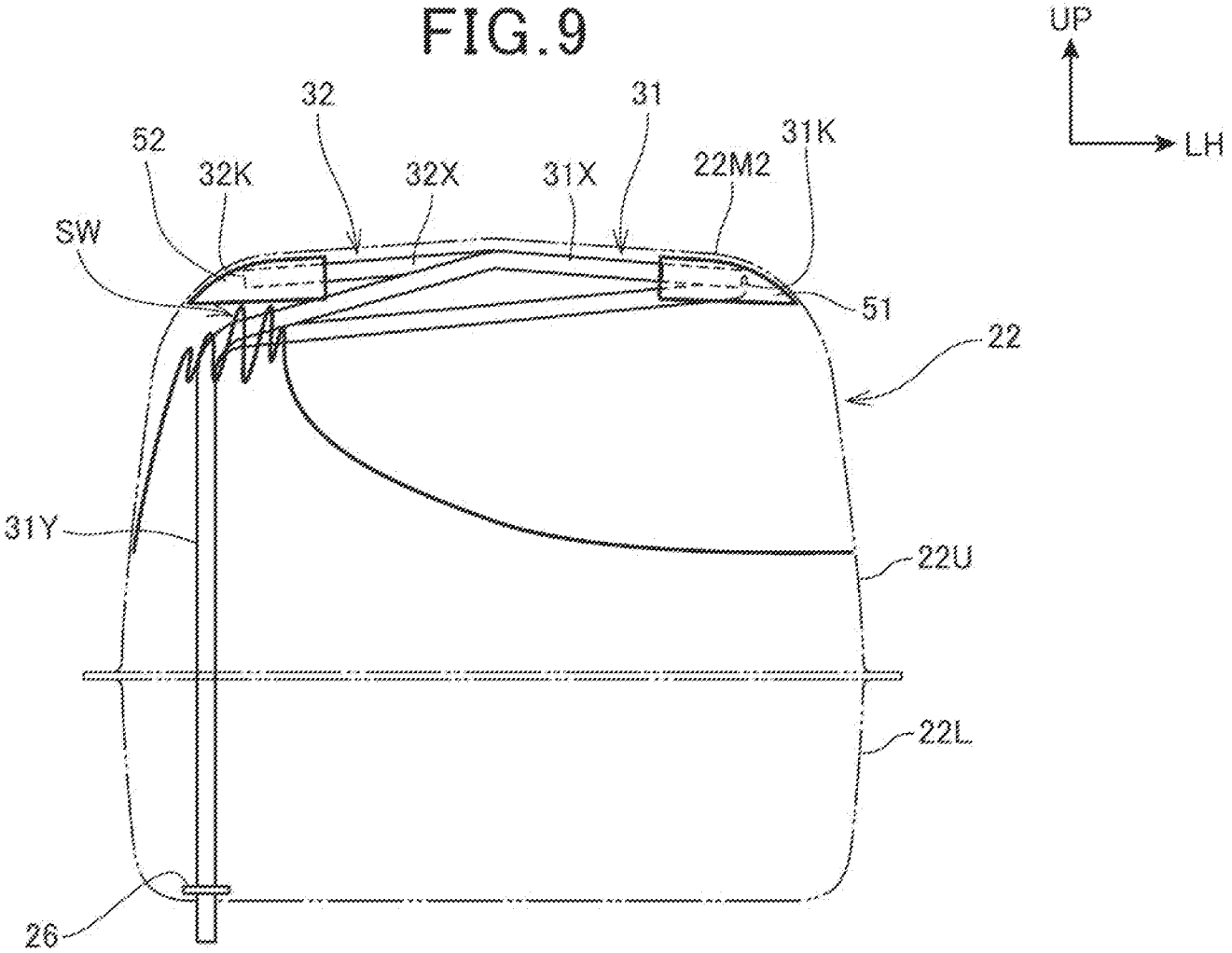
FIG. 9 is a view of the inside of a fuel tank of an engine generator according to a third embodiment as viewed from the rear side.
Figure 10:
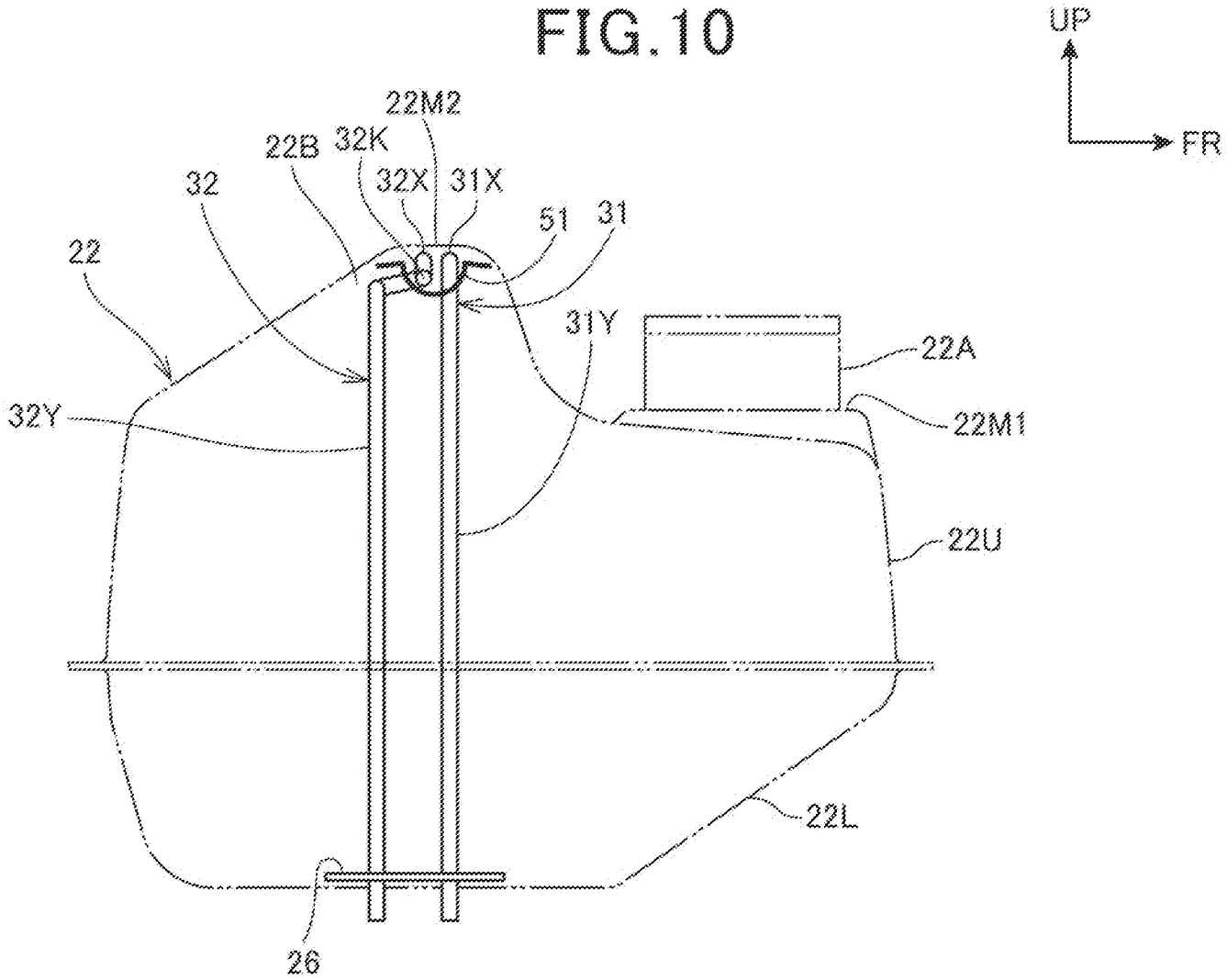
FIG. 10 is a view of the inside of a fuel tank as viewed from the right side.

FIG. 9 is a view of the inside of a fuel tank 22 of an engine generator 1 according to a third embodiment as viewed from the rear side, and FIG. 10 is a view as viewed from the right side.

In FIG. 9, a reference character SW denotes a wave generated in the liquid fuel due to vibration from the outside.

The third embodiment includes wave protection members 51 and 52 arranged around openings 31K and 32K in the fuel tank 22 of the first embodiment to enable preventing the wave SW of the liquid fuel from getting into the openings 31K and 32K.

As shown in FIG. 9, the wave protection members 51 and 52 extend from outer positions of the respective openings 31K and 32K in the left-right direction to the inner positions of the respective openings 31K and 32K in the left-right direction. In addition, as shown in FIG. 10, the wave protection members 51 and 52 are formed of a plate members extending along a crescent-shaped arc in a side view. As a result, the lower parts of the openings 31K and 32K are each covered from the left to right, and this enables effectively preventing the wave SW of the liquid fuel from getting into the openings 31K and 32K.

In the examples of FIGS. 9 and 10, the respective wave protection members 51 and 52 are joined to the upper surface of the fuel tank 22 (the upper surface of a tank bulge section 22B) at both the front and rear end portions thereof by welding or the like, to be fixed to the fuel tank 22. The respective wave protection members 51 and 52 can be made by using plate members made of various materials such as metal plates. Note that, if the wave SW of the liquid fuel can be prevented from getting into the openings 31K and 32K, the wave protection members 51 and 52 may be appropriately changed in the shapes and structures for fixing, and the wave protection members 51 and 52 may be formed as an integral component. In addition, the wave protection members 51 and 52 may be applied to the second embodiment.

In this way, the wave protection members 51 and 52 for preventing the wave SW of the liquid fuel from getting into the respective openings 31K and 32K are provided, so that the leakage of liquid fuel through breather passages 31 and 32 can further be prevented.

Each of the above-described embodiments is merely an aspect of the present invention, and can be modified and applied in any way without departing from the spirit of the present invention.

For example, the case in which the present invention is applied to the engine generator 1 shown in FIG. 1 and the like has been described, but the shape including the tank bulge section 22B and/or the shape of individual portions such as the breather passages 31 and 32 may be appropriately changed. In addition, the present invention may be applied to other known engine generators.

In addition, in each of the above-described embodiments, the right direction is defined as the first direction and the left direction is defined as the second direction, and the cases are described in which the pressure variation in the fuel tank can be prevented and the fuel leakage can be prevented even if the fuel tank is inclined in the first direction and the second direction, but the first direction and the second direction may be defined as other directions.

In addition, although the cases are described in which the present invention is applied to an engine generator, the present invention may be applied to a work machine or the like other than engine generators.

REFERENCE SIGNS LIST

1 engine generator (work machine)
10 housing
11 control panel
12 tank cap
21 engine
22 fuel tank
22A fuel supply port
22B tank bulge section
22M1 fuel supply port arrangement surface
22M2 upward bulging surface
23 air cleaner case
26 fixing member
31, 32 breather passage (first and second breather passages)
31K, 32K opening
31X, 32X head portion
31Y, 32Y base portion
35 hose joint
36, 37, 38, 42, 43 piping member
41 canister
51, 52 wave protection member
S1, S2, S2R, S3R, S2L, S3L fuel oil level

The invention claimed is:

1. A work machine, comprising a fuel tank for storing liquid fuel, wherein the fuel tank has a tank shape and includes: a fuel supply port; and a tank bulge section that bulges to a position higher than the fuel supply port, the tank bulge section being formed, at an intermediate position in a front-rear direction of the fuel tank, so as to have a cross section in which a front-rear length decreases to the upper side, wherein the fuel tank comprises a breather passage through which an inside and an outside of the tank bulge section communicate with each other, and wherein the breather passage comprises:

a first breather passage having an opening at a position above the liquid fuel in the tank bulge section when the work machine is inclined in a first direction, the first direction being one of left and right directions, the position of the first breather passage opening being intermediate in the front-rear direction of the fuel tank, the first breather passage being routed so as to include a position above the liquid fuel when the work machine is inclined in a second direction, the second direction being the other of the left and right directions; and a second breather passage having an opening at a position above the liquid fuel in the tank bulge section when the work machine is inclined in the second direction, he position of the second breather passage opening being intermediate in the front-rear direction of the fuel tank, the second breather passage being routed so as to include a position above the liquid fuel when the work machine is inclined in the first direction.

2. The work machine according to claim 1, wherein a V-shaped cross section of the tank bulge section extends over a width direction of the fuel tank.

3. The work machine according to claim 1, wherein the first breather passage extends from the opening of the first breather passage along the first direction and then extends downward along a side wall of the fuel tank, and wherein the second breather passage extends from the opening of the second breather passage along the second direction, then turns back to extend along the first direction, and then extends downward along the side wall of the fuel tank.

4. The work machine according to claim 1, wherein the first and second breather passages have a downward slope toward the opening of the first breather passage and the opening of the second breather passage, respectively.

5. The work machine according to claim 1, wherein the first and second breather passages are arranged in the fuel tank, exit from a predetermined position in the fuel tank, and subsequently are connected to a canister or an air cleaner case.

6. The work machine according to claim 1, wherein a portion of the first breather passage except for the opening of the first breather passage and a portion of the second breather passage except for the opening of the second breather passage are arranged outside the fuel tank, and the first and second breather passages are connected to a canister or an air cleaner case.

7. The work machine according to claim 1, wherein the fuel tank has a wave protection member arranged around the opening of the first breather passage and the opening of the second breather passage in the fuel tank to enable preventing a wave of the liquid fuel from getting into the opening of the first breather passage and the opening of the second breather passage.

8. The work machine according to claim 1, wherein the work machine is a portable type generator that uses the liquid fuel in the fuel tank to generate electricity, and a left-right length of the work machine is shorter than a front-rear length of the work machine.

* * * * *